US007131864B2

(12) United States Patent
Peng

(10) Patent No.: US 7,131,864 B2
(45) Date of Patent: Nov. 7, 2006

(54) BEZEL OF MODULAR JACK

(76) Inventor: Yuan-Huei Peng, 4 Fl., No. 12, Lane 270, Sec. 3, Beishen Rd., Shenkeng Shiang, Taipei (TW)

( * ) Notice: Subject to any disclaimer, the term of this patent is extended or adjusted under 35 U.S.C. 154(b) by 0 days.

(21) Appl. No.: 11/001,923

(22) Filed: Dec. 2, 2004

(65) Prior Publication Data

US 2006/0019533 A1 Jan. 26, 2006

(30) Foreign Application Priority Data

Jul. 23, 2004 (TW) ..... 93211725 U

(51) Int. Cl.
*H01R 13/60* (2006.01)

(52) U.S. Cl. ..... 439/536; 439/557

(58) Field of Classification Search ..... 439/536, 439/537, 557, 553, 554
See application file for complete search history.

(56) References Cited

U.S. PATENT DOCUMENTS 3,514,743 A * 5/1970 Schantz ..... 439/557
5,096,439 A * 3/1992 Arnett ..... 439/536
5,125,852 A * 6/1992 Archer ..... 439/555
5,356,311 A * 10/1994 Liu ..... 439/536
5,658,166 A * 8/1997 Freeman et al. ..... 439/540.1
5,800,208 A * 9/1998 Ishizuka et al. ..... 439/557
5,897,395 A * 4/1999 Arnett ..... 439/536
6,200,160 B1 * 3/2001 Drexler et al. ..... 439/536
6,373,944 B1 * 4/2002 Beavers ..... 379/438
6,422,898 B1 * 7/2002 Harvey et al. ..... 439/536
6,793,524 B1 * 9/2004 Clark et al. ..... 439/536

* cited by examiner

*Primary Examiner*—Gary F. Paumen
(74) *Attorney, Agent, or Firm*—Volpe & Koenig, P.C.

(57) ABSTRACT

A bezel of a modular jack is provided. The bezel for positioning different types of modular jacks includes a body, a first positioning device and a second positioning device. The body is used for containing therein a modular jack. The first positioning device is used for positioning the first type modular jack and includes a first widthwise slot and a second widthwise slot. The second positioning device is used for positioning the second type modular jack and includes a first lengthwise slot and the second lengthwise slot.

20 Claims, 12 Drawing Sheets

BEZEL OF MODULAR JACK

FIELD OF THE INVENTION

This invention mainly relates to a bezel of a modular jack, and more particularly to a bezel for engaging a keystone jack or a modular jack with a wall plate.

BACKGROUND OF THE INVENTION

Generally, a plug for a communication system is usually plugged into the keystone jack mounted on the wall and the metal wire holder of the keystone jack has plural metal wires for connecting with a plug and a printed circuit board (PCB). The metal wire holder can be applied to a keystone jack or a keystone panel. Please refer to FIG. 1, which is the three-dimensional diagram illustrating a keystone jack and its corresponding keystone panel according to the prior art.

As shown in FIG. 1, a keystone jack 10 produced by American Metal Product Company is designed to be inserted into its corresponding keystone panel 11 by respectively engaging the two oblong-shaped slots 12 and 13 of the keystone panel 11 with the two widthwise protrusions 14 and 15 of the keystone jack 10, wherein the widthwise protrusions 14 and 15 are respectively located on the top surface A and the elastically extending piece 16 of the keystone jack 10.

Please refer to FIGS. 2(A)–(B). FIG. 2(A) is a three-dimensional diagram illustrating a conventional modular jack and its corresponding modular wall plate according to the prior art, and FIG. 2(B) is a vertical view of the conventional modular jack shown in FIG. 2(A). As shown in FIGS. 2(A)–2(B), a modular jack 20 produced by AVAYA Company is designed to be inserted into its corresponding modular wall plate 21 by respectively engaging the two oblong-shaped slots 22 and 23 of the modular wall plate 21 with the two lengthwise protrusions 24 and 25 of the modular jack 20. The lengthwise protrusions 24 and 25 are respectively located on the left side and the right side of the modular jack 20.

Since the keystone jack 10 and the modular jack 20 are produced by different companies and the designs of the engaging devices of these two companies are different, the keystone panel 11 and modular wall plates 21 could be used only for their own corresponding modular jacks and the producing molds thereof should be made separately. Certainly, once customers want to change the keystone jack 10 with the modular jack 20 and vice versa, the corresponding keystone panel 11 and modular wall plates 21 would not be suitable anymore and should be changed accordingly. Therefore, the cost of buying the new corresponding keystone panel or modular wall plate and the discards of the former keystone panel or modular wall plate are considered uneconomical. That is to say, either the engagement between the keystone jack 10 and the keystone panel 11 or those between the modular jack 20 and the modular wall plate 21 are unideal.

In view of the foresaid descriptions, a bezel for different jacks is expected, and more particularly a bezel for the two different types of keystone jack 10 and modular jacks 20 shown in FIGS. 1–2 is expected. Therefore, the applicant provides a bezel of a modular jack to overcome the discrepancy and the incompatibility in the wall plates of the foresaid two modular jacks. The bezel provided in the present invention not only overcomes the foresaid disadvantages but also brings the advantages of that the wall plate with the bezel could be applied for more kinds of modular jacks, and it is more convenient for the customers to replace the different modular jacks.

SUMMARY OF THE INVENTION

In one respect of the present invention, a bezel for positioning a modular jack is provided, wherein the modular jack is one of a first and a second modular jacks. The bezel includes a body having first opposing sides and second opposing sides for containing therein the modular jack, a first positioning device having a first and a second slots on the first opposing sides for positioning the first modular jack, and a second positioning device having a third and a fourth slot on the second opposing sides for positioning the second modular jack.

Preferably, the first positioning device further has a first and a second cambered surfaces and a first and a second prop surfaces for positioning and securing the first modular jack, and the first and the second slots are oblong-shaped.

Preferably, the first modular jack has a first and a second protrusions for respectively engaging the first and the second prop surfaces, and the first and the second protrusions are respectively located on a top and an extended piece of the first modular jack to form an upper fastener and a lower fastener.

Preferably, the second positioning device further has a first and a second planer surfaces and a third and a fourth prop surfaces for positioning and securing the second modular jack, and the third and the fourth slots are oblong-shaped.

Preferably, the second modular jack has a third and a fourth protrusions for respectively engaging the third and the fourth prop surfaces, and the third and the fourth protrusions are respectively located on a left and a right sides of the second modular jack to form a left fastener and a right fastener.

Preferably, the bezel is further connected to a first plate, wherein the bezel has a protrusion for positioning and securing the first plate to a metal panel, and the first plate and the bezel are integrally formed.

Preferably, the bezel is a first bezel and is connected to a second plate with a second bezel, wherein the first bezel, the second bezel and the second plate are integrally formed.

Preferably, the bezel is a first bezel and is connected to a third plate with a second bezel and a third bezel, wherein the first bezel, the second bezel, the third bezel and the third plate are integrally formed.

Preferably, the bezel is a first bezel and is connected to a fourth plate with a second bezel, a third bezel and a fourth bezel, wherein the first bezel, the second bezel, the third bezel, the fourth bezel and the fourth plate are integrally formed.

In another aspect of the present invention, a bezel for positioning a modular jack is provided, wherein the modular jack is one of a first and a second modular jacks. The bezel includes a body for containing therein the modular jack, a first positioning device having a first and a second slots on first opposing sides of the body for positioning the first modular jack, and a second positioning device for positioning the second modular jack.

Preferably, the second positioning device includes a third and a fourth slots on second opposing sides of the body for positioning the second modular jack.

Preferably, the third and the fourth slots are oblong-shaped, and the second positioning device further has a first and a second planar surfaces and a first and a second prop surfaces for positioning and securing the second modular jack.

Preferably, the second modular jack has a third and a fourth protrusions for respectively engaging the first and the second prop surfaces, and the third and the fourth protrusions are respectively located on a left and a right sides of the second modular jack to form a left fastener and a right fastener.

Preferably, the first and the second slots are oblong-shaped, and the first positioning device further has a first and a second cambered surfaces and a third and fourth prop surfaces for positioning and securing the first modular jack.

Preferably, the first modular jack has a first and a second protrusions for respectively engaging the third and the fourth prop surfaces, and the first and the second protrusions are respectively located on a top and an extended piece of the first modular jack to form an upper fastener and a lower fastener.

In another aspect of the present invention, a bezel for positioning a modular jack is provided, wherein the modular jack is one of a first and a second modular jacks. The bezel includes a body for containing therein the modular jack, a first positioning device for positioning the first modular jack, and a second positioning device for securing the second modular jack.

Preferably, the first positioning device includes a first and a second slots on first opposing sides of the body for positioning and securing the first modular jack and the second positioning device includes a third and a fourth slots on second opposing sides of the body for positioning and securing the second modular jack.

Preferably, the first and the second slots are oblong-shaped, and the first positioning device further has a first and a second cambered surfaces and a first and a second prop surfaces for positioning and securing the first modular jack.

Preferably, the first modular jack has a first and a second protrusions for respectively engaging the first and the second prop surfaces, and the first and the second protrusions are respectively located on a top and an extended piece of the first modular jack to form an upper fastener and a lower fastener.

Preferably, the third and the fourth slots are oblong-shaped, and the second positioning device further has a first and a second planar surfaces and a third and a fourth prop surfaces for positioning and securing the second modular jack.

The above objects and advantages of the present invention will become more readily apparent to those ordinarily skilled in the art after reviewing the following detailed descriptions and accompanying drawings, in which:

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only; it is not intended to be exhaustive or to be limited to the precise form disclosed.

Figure 3A:
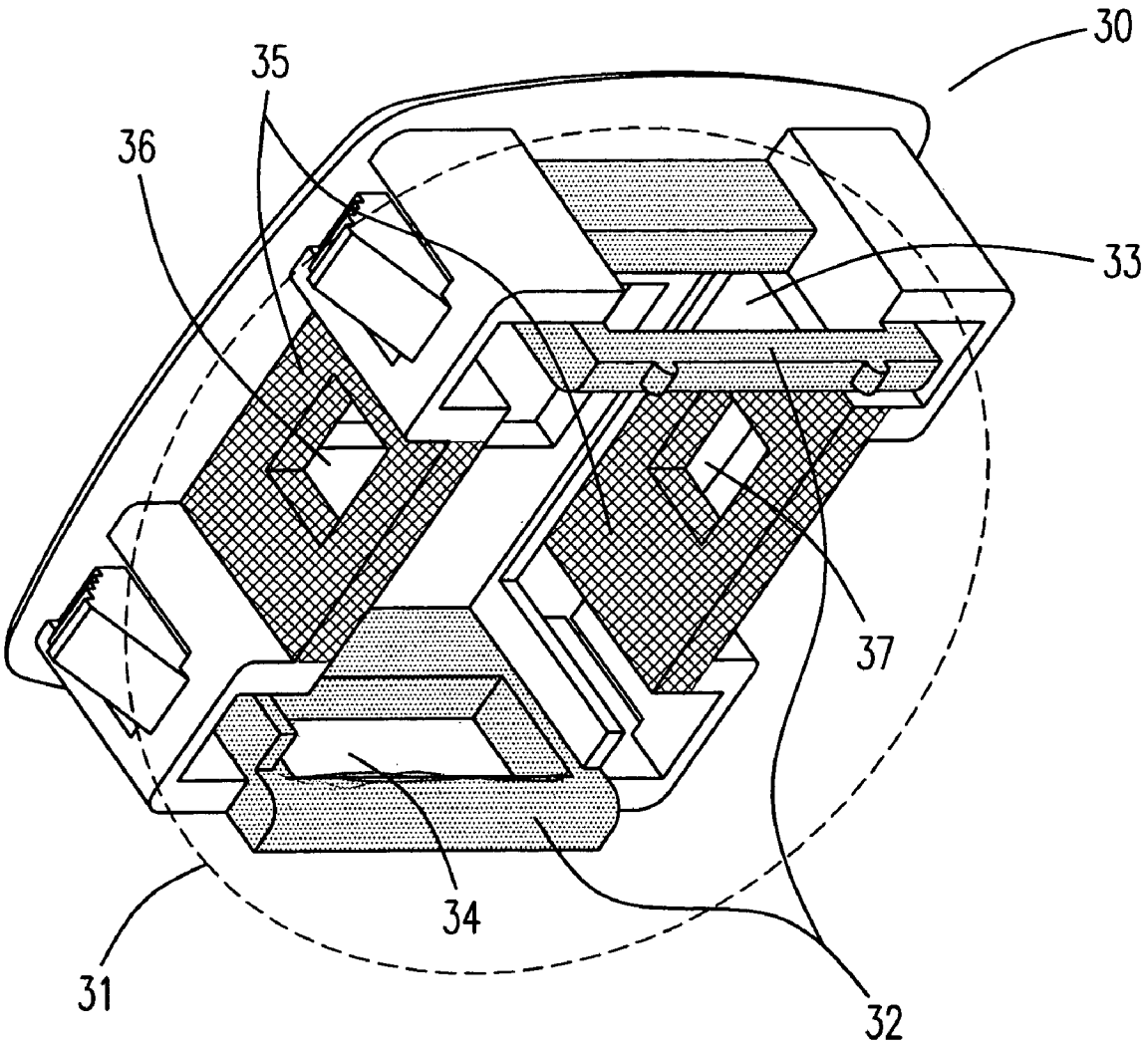
FIGS. 3(A)–3(C) are different views of a bezel of a modular jack according to a first preferred embodiment of the present invention.
Figure 3B:
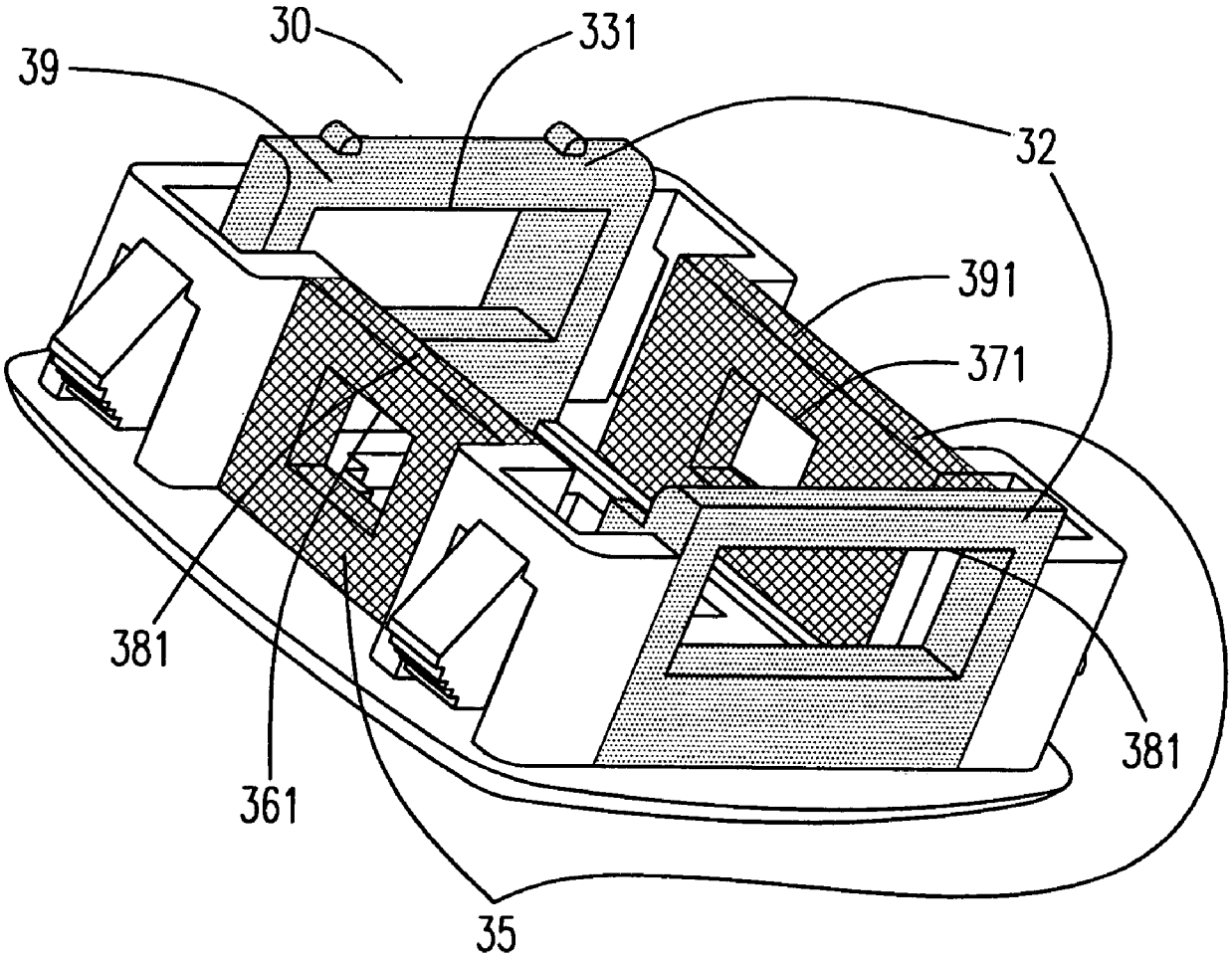
Figure 3C:
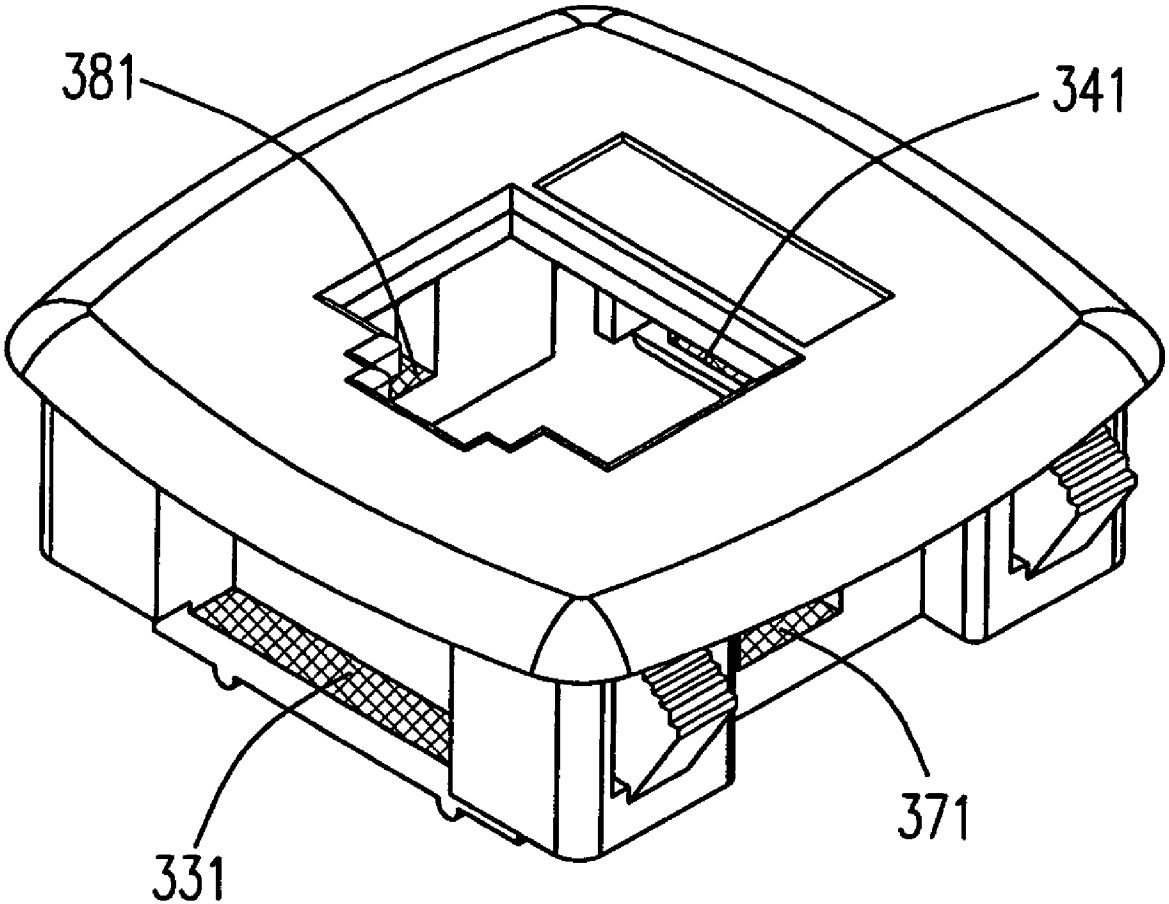

Please refer to FIGS. 3(A)–3(C), which are diagrams showing the bezel of a modular jack according to a first preferred embodiment of the present invention. As shown is FIGS. 3(A)–3(C), the bezel 30 for a modular jack (not shown) includes the body 31, the first positioning device 32 and the second positioning device 35.

The first positioning device 32 includes the first widthwise slot 33, the second widthwise slot 34, the cambered surface 38, the second cambered surface 39, the first prop surface 331 and the second prop surface 341, wherein the first widthwise slot 33 and the second widthwise slot 34 are oblong-shaped. The second positioning device 35 includes the first lengthwise slot 36, the second lengthwise slot 37, the first planar surface 381, the second planar surface 391, the third prop surface 361 and the fourth prop surface 371, wherein the first lengthwise slot 36 and the second lengthwise slot 37 are oblong-shaped.

Figure 1:
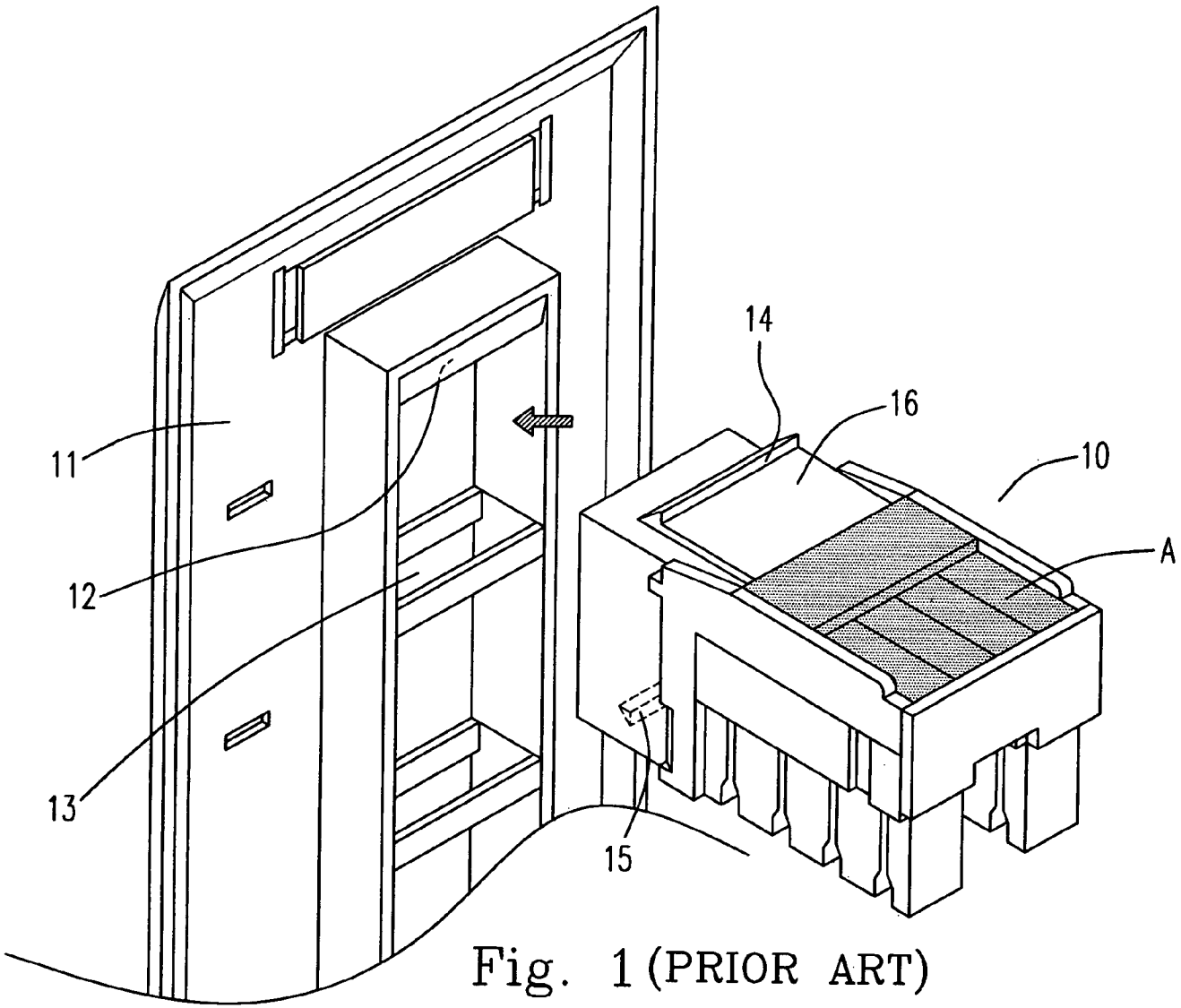
Fig. 1 (PRIOR ART)
FIG. 1 is a three-dimensional diagram illustrating a keystone jack and its corresponding keystone panel according to the prior art.

Please refer to FIG. 1 and FIGS. 3(A)–3(C), the body 31 is used for containing therein the keystone jack 10 shown in FIG. 1 and the first positioning device 32 is used for positioning the keystone jack 10. The first cambered surface 38 and the second cambered surface 39 are used for easily inserting the keystone jack 10 into the first widthwise slot 33 and the second widthwise slot 34. Since the first and the second protrusions 14 and 15 are respectively located on the top surface A and the elastically extending piece 16 of the keystone jack 10, an upper fastener and a lower fastener could be formed by propping the first protrusion 14 and the second protrusion 15 with the first prop surface 331 and the second prop surface 341 of the first positioning device 32.

Figure 2A:
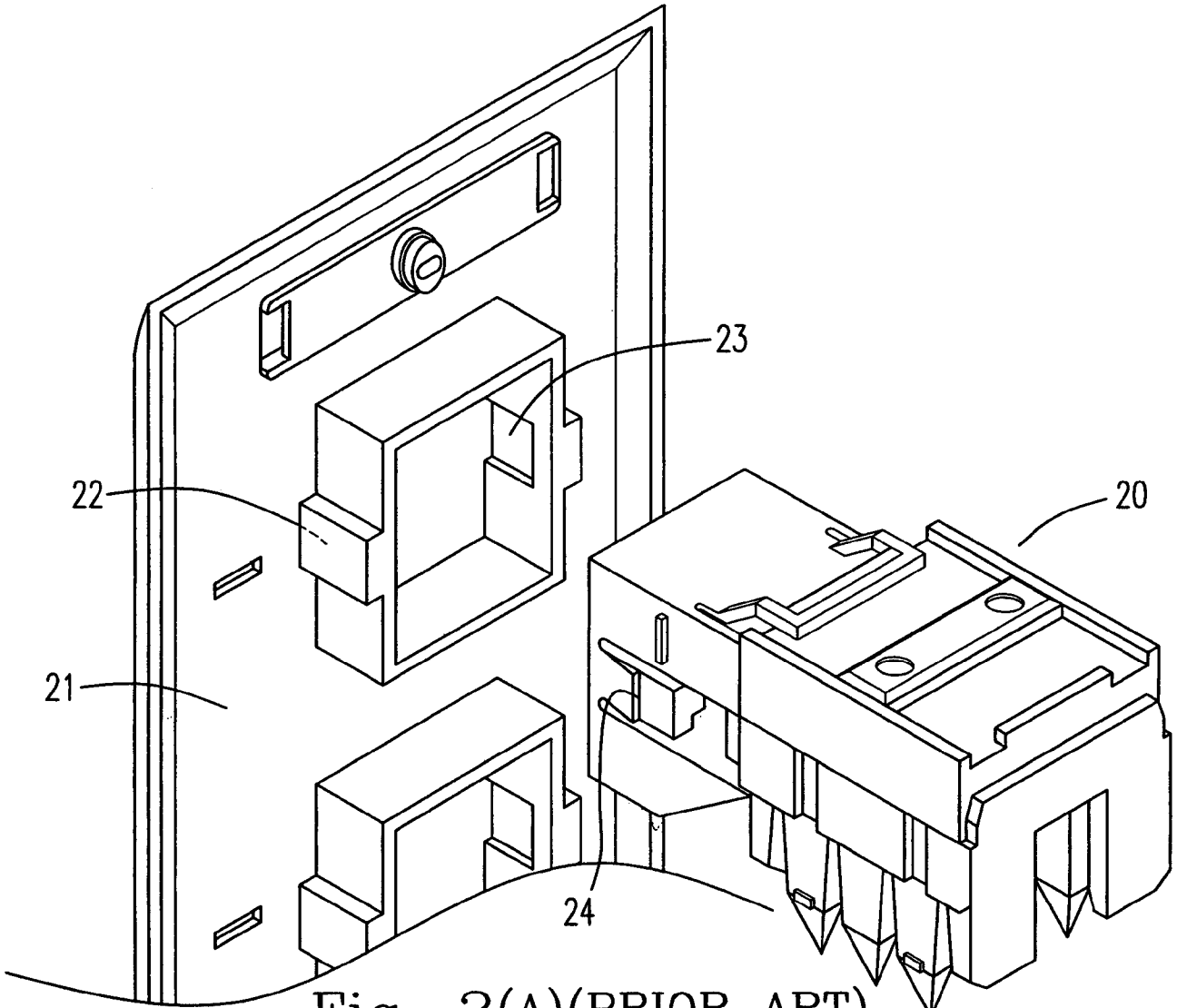
Fig. 2(A)(PRIOR ART)
FIG. 2(A) is a three-dimensional diagram illustrating a modular jack and its corresponding modular wall plate according to the prior art.

Please refer to FIGS. 2(A)–3(C), the body 31 is used for containing therein the modular jack 20 shown in FIG. 2 and the second positioning device 35 is used for positioning the modular jack 20. The first planar surface 381 and the second planar surface 391 are used for easily inserting the modular jack 20 into the first lengthwise slot 36 and the second lengthwise slot 37.

Since the first and the second protrusions 24 and 25 are respectively located on the left and the right sides of modular jack 20, a left fastener and a right fastener could be formed by propping the first protrusion 24 and the second protrusion 25 with the third prop surface 361 and the fourth prop surface 371 of the second positioning device 35.

It should be noted that the widthwise slot 33 and the second withwise slot 34 of the first position device 32 could be replaced by other engaging element. Similary, the first lengthwise slot 36 and the second lengthwise slot 37 of the second positioning device 35 could be replace by other engaging element.

Figure 4:
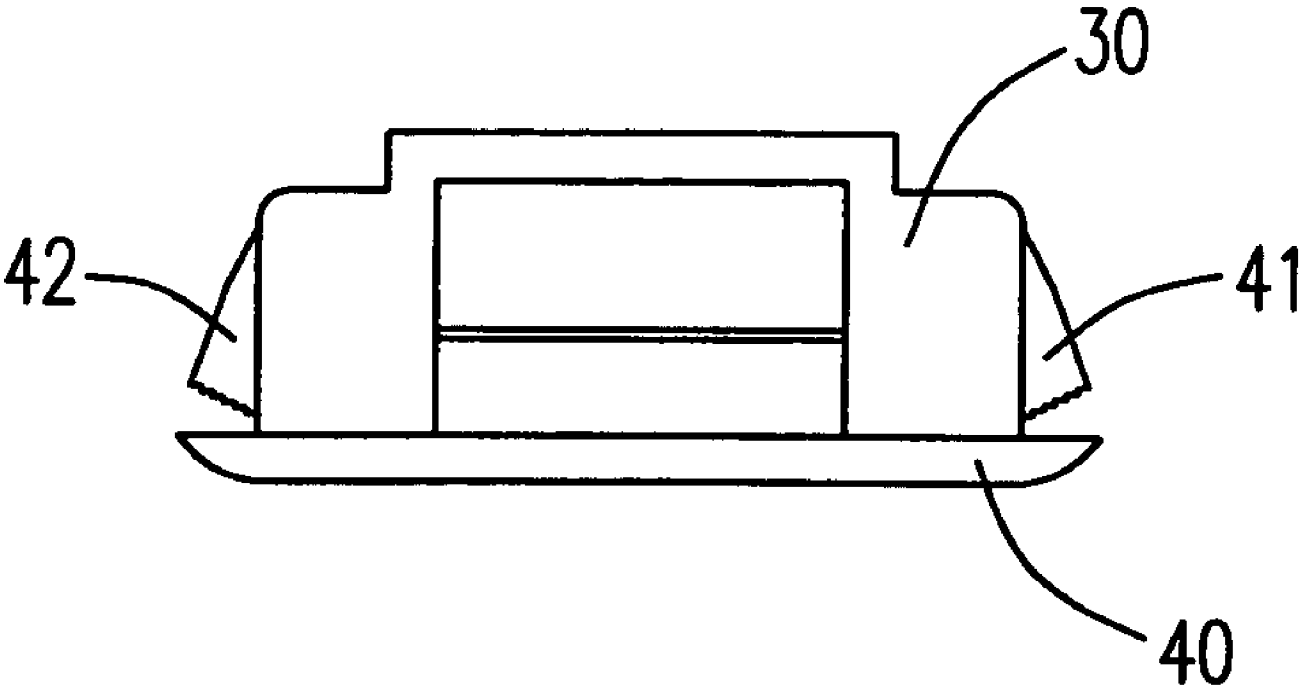
FIG. 4 is a lateral view of the bezel of the modular jack shown in FIG. 3(A)

Furthermore, please refer to FIG. 4, which is a diagram showing the bezel of a modular jack shown in FIG. 3(A). As shown in FIG. 4, the bezel 30 further includes the panel 40, the tenons 41 and 42, wherein the tenon 41 of the bezel 30 is used for engaging the bezel 30 to a metal board (not shown). It should be noted that plural bezels 30 might be used together on a board by being inserted therein, if necessary.

Figure 5A:
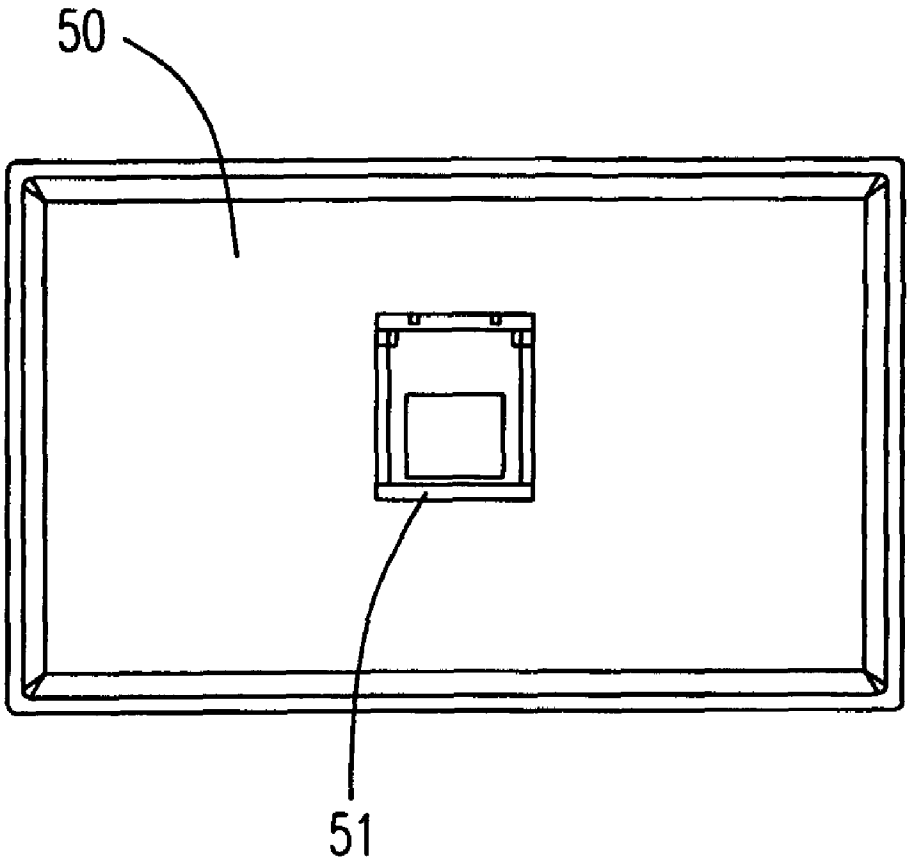
FIGS. 5(A)–5(B) are different views of a bezel according to the second preferred embodiment of the present invention.
Figure 5B:
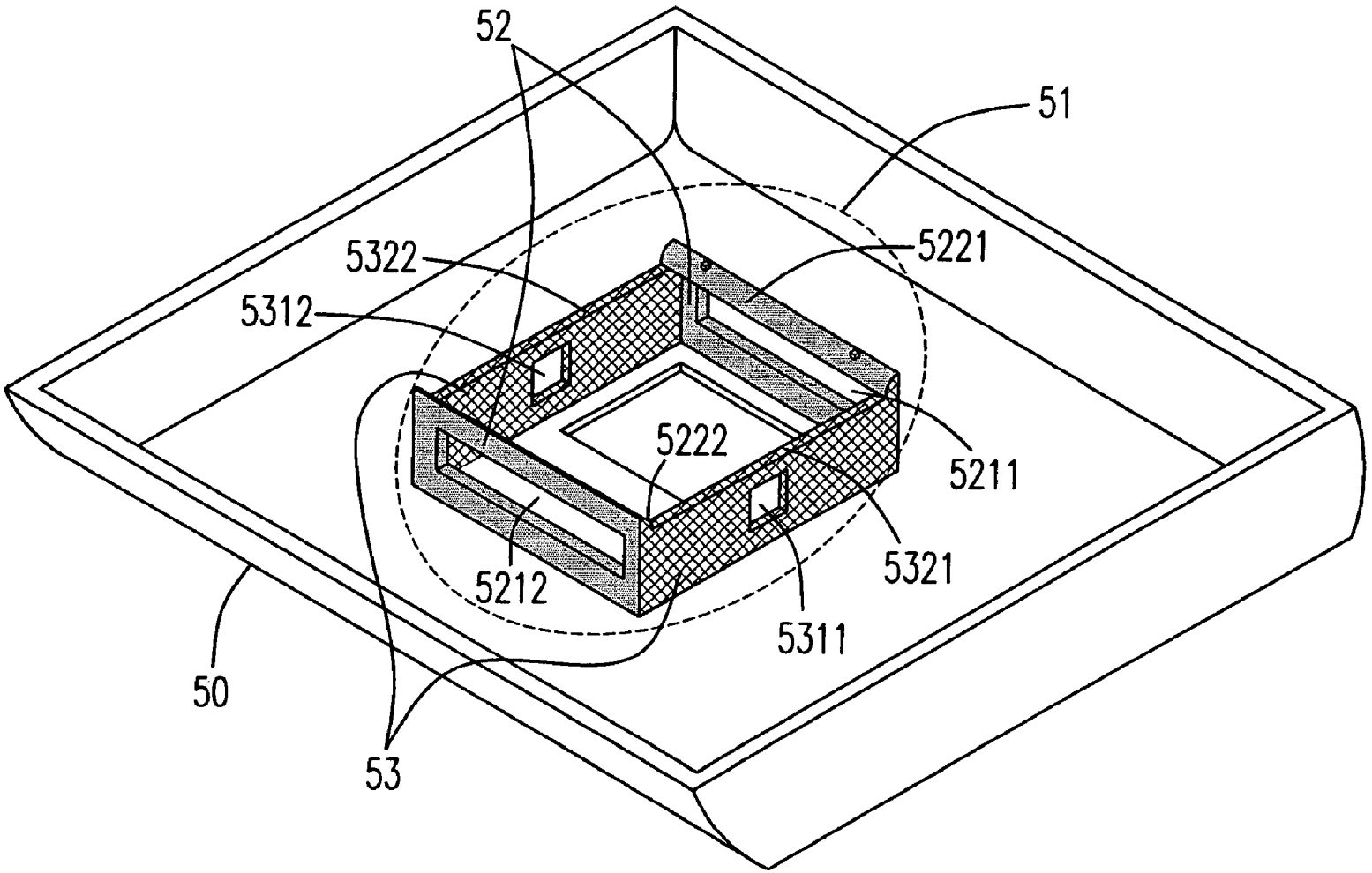

Please refer to FIGS. 5(A)–5(B), which are different views of a bezel according to the second preferred embodiment of the present invention. As shown in FIGS. 5(A)–5(B), the bezel 51 can be integrally formed on the one-port wall plate 50. The bezel 51 is similar to the bezel 30. The bezel 51 used for containing therein a modular jack includes the first positioning device 52 and the second positioning device 53.

The first positioning device 52 includes the first widthwise slot 5211, the second widthwise slot 5212, the first cambered surface 5221 and the second cambered surface 5222, wherein the first widthwise slot 5211 and the second widthwise slot 5212 are oblong-shaped. The second positioning device 53 includes the first lengthwise slot 5311, the second lengthwise slot 5312, the first planar surface 5321 and second planar surface 5322, wherein the first lenghthwise slot 5311 and second lengthwise slot 5312 are oblong-shaped. Even though several elements of the drawings for the second embodiment cannot be seen herein, the first positioning device 52 could still further includes the first prop surface and the second prop surface (not shown) respectively, and the second positioning device 53 further includes the third prop surface and the fourth prop surface (not shown).

Please refer to FIG. 1 and FIG. 5(B), the bezel 51 could be used for containing the keystone jack 10 shown in FIG. 1, wherein the first positioning device 52 is used for positioning the keystone jack 10. The first cambered surface 5221 and the second cambered surface 5222 are used for easily inserting the keystone jack 10 into the first widthwise slot 5211 and the second widthwise slot 5212. Since the first and the second protrusions 14 and 15 are respectively located on the top surface A and the elastically extending piece 16 of the keystone jack 10, an upper fastener and a lower fastener could be formed by propping the first protrusion 14 and the second protrusion 15 with the first prop surface and the second prop surface (not shown) of the first positioning device 52.

Figure 2B:
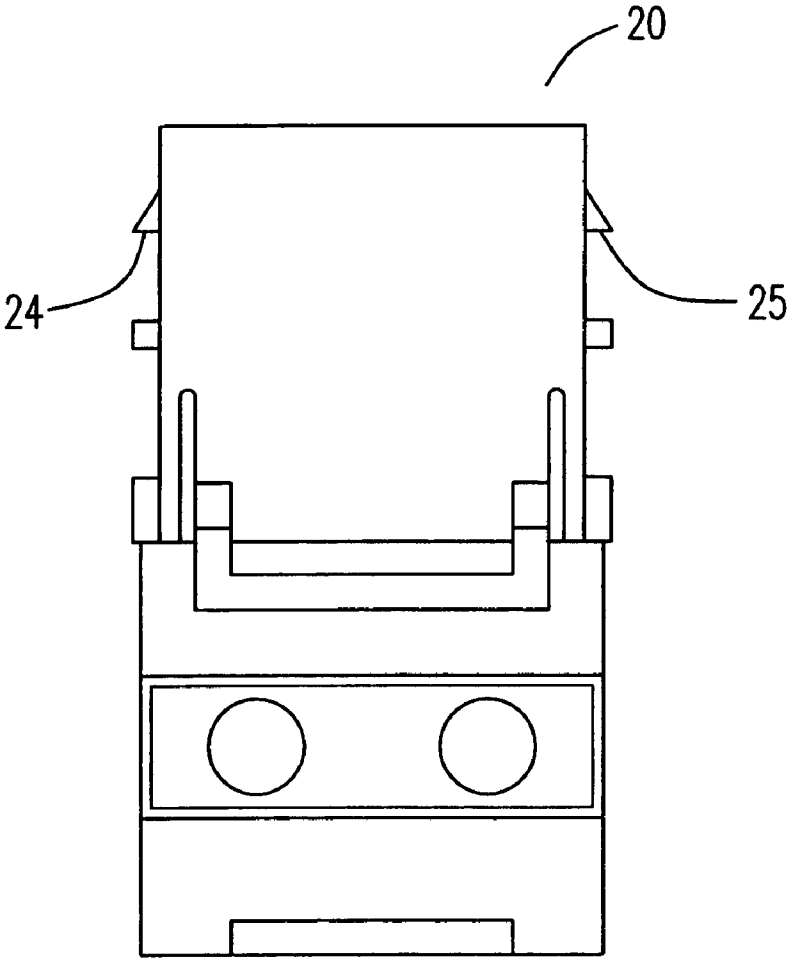
Fig. 2(B)(PRIOR ART)
FIG. 2(B) is a vertical view of the conventional modular jack shown in FIG. 2(A)

Please refer to FIGS. 2(A)–2(B) and 5(B), the bezel 51 could be used for containing therein the modular jack 20 shown in FIG. 2 and the second positioning device 53 is used for positioning the modular jack 20. The first planar surface 5321 and the second planar surface 5322 are used for easily inserting the modular jack 20 into the first lengthwise slot 5311 and the second lengthwise slot 5312.

Since the first and the second protrusions 24 and 25 are respectively located on the left and the right sides of modular jack 20, a left fastener and a right fastener could be formed by propping the first protrusion 24 and the second protrusion 25 with the third prop surface and the fourth prop surface (not shown) of the second positioning device 35.

It should be noted that the widthwise slot 33 and the second widthwise slot 34 of the first positioning device 32 could be replaced by other engaging elements. Similarly, the first lengthwise slot 36 and the second lengthwise slot 37 of the second positioning device 3 could be replaced by other engaging elements.

Figure 6:
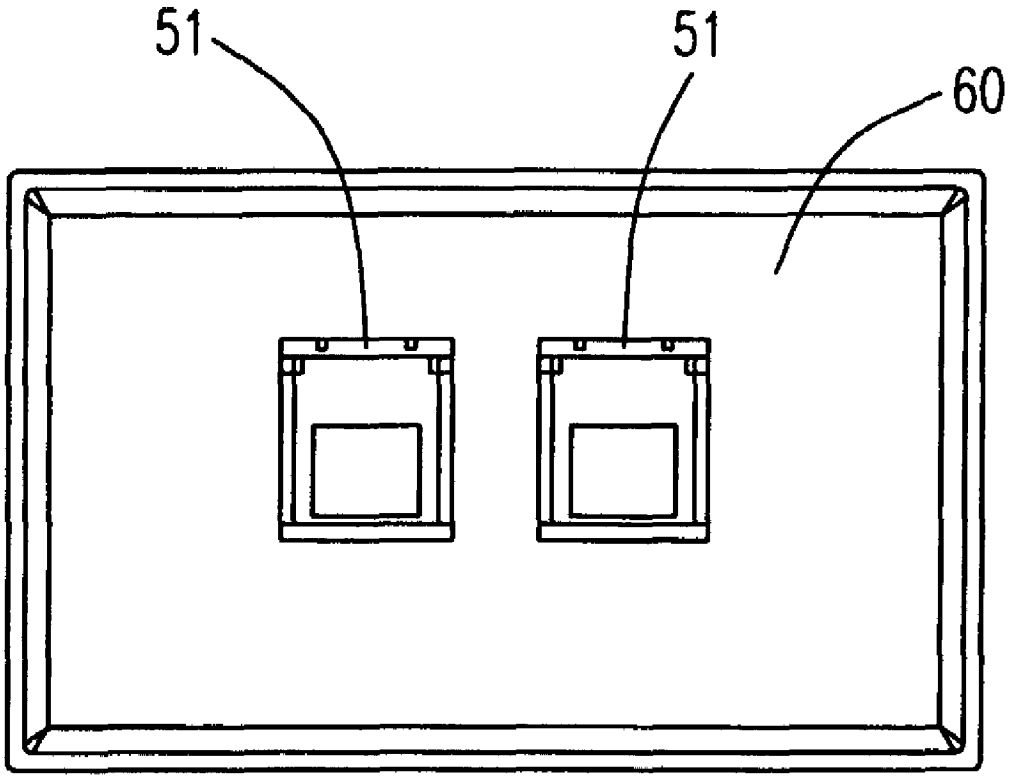
FIGS. 6–8 are diagram showing the bezels according to the second preferred embodiment of the present invention, wherein the bezels are integrally formed on a wall plate.
Figure 7:
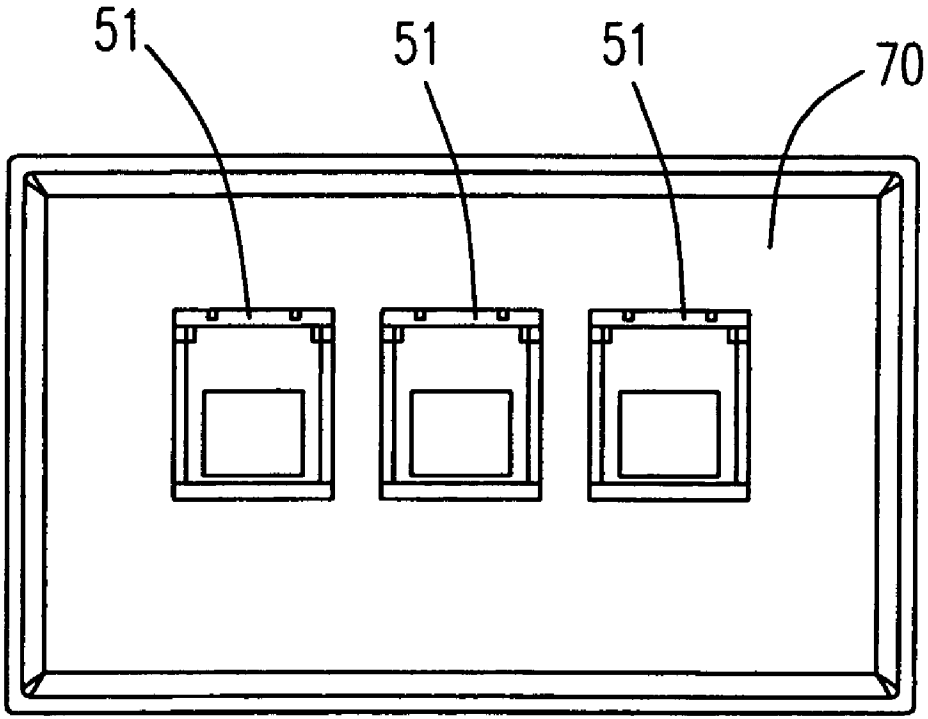
Figure 8:
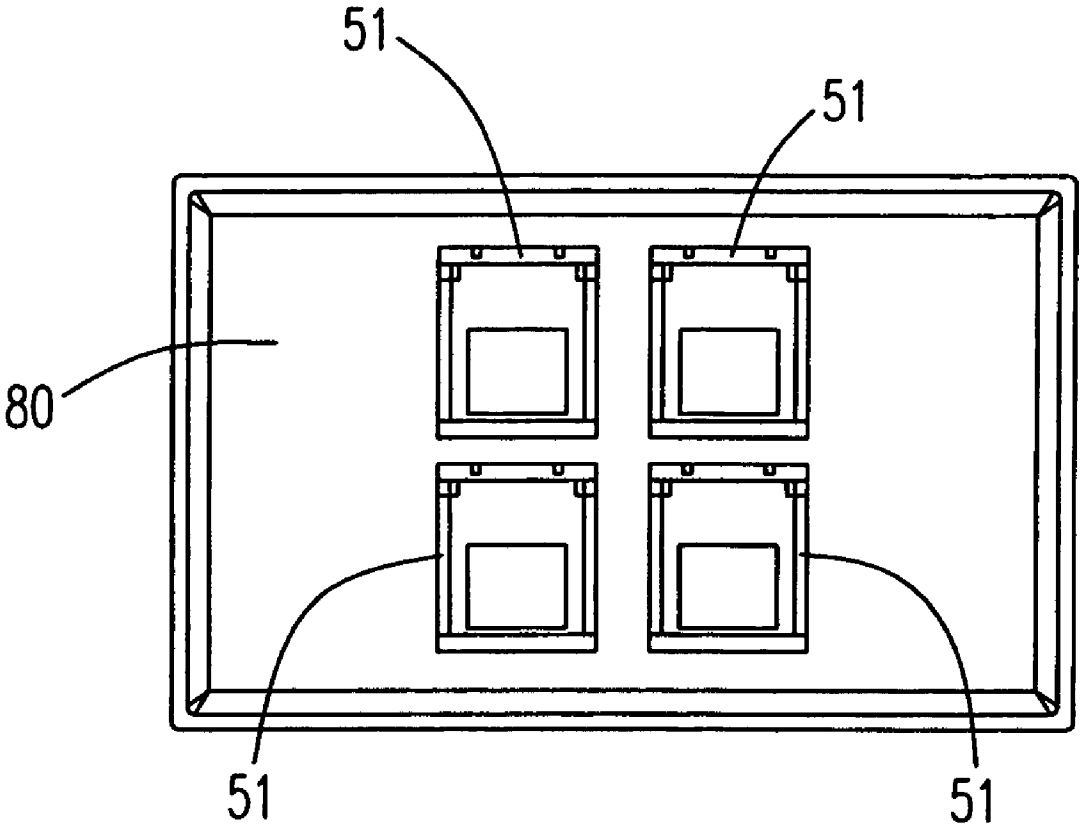

The bezel 51 could be combined with the multi-port wall plate, and more particularly several bezels 51 are integrally formed on the wall plate. Please refer to FIGS. 6–8, which show three applications of bezels 51 according to the second preferred embodiment of the present invention, wherein the bezels 51 can be integrally formed on the wall plate. As shown in FIG. 6, two bezels 51 are integrally formed on the two-port wall plate 60. As shown in FIG. 7, three bezels 51 are integrally formed on the three-port wall plate 70. Also, as shown in FIG. 8, four bezels 51 are integrally formed on the four-port wall plate 80. Certainly, the combination between the bezel 51 and the multi-port wall plate could be performed as desires.

As the foresaid descriptions, the present invention provides a bezel with a first repositioning device and a second repositioning device for positioning either a keystone jack or a modular jack. The usage of the two sets of positioning device set on two opposing sides of the bezel for achieving the two types of the jack positioning is good for the industrial production.

Therefore, the bezel provided in the present invention provides the structure for effectively overcoming the disadvantages of the prior art. To sum up, the bezel provided in the present invention does have the novelty, the progressiveness, and the utility in the industry.

While the invention has been described in terms of what is presently considered to be the most practical and preferred embodiment, it is to be understood that the invention needs not be limited to the disclosed embodiments. On the contrary, it is intended to cover various modifications and similar arrangements included within the spirit and scope of the appended claims which are to be accorded with the broadest interpretation so as to encompass all such modifications and similar structures.

What is claimed is:

1. A bezel for positioning a modular jack, wherein said modular jack is one of first and second types of differently-shaped modular jacks, the bezel comprising:

a body having first opposing sides and second opposing sides for containing therein one of said modular jacks;

a first positioning device having first and second slots on said first opposing sides configured to position only said first modular jack; and a second positioning device having third and fourth slots on said second opposing sides configured to position only said second modular jack.

2. The bezel according to claim 1, wherein said first positioning device has first and second cambered surfaces and first and second prop surfaces for positioning and securing said first modular jack, and said first and second slots are oblong-shaped.

3. The bezel according to claim 2, wherein said first modular jack has first and second protrusions for respectively engaging said first and second prop surfaces, and said first and second protrusions are respectively located on a top surface of an extended piece of said first modular jack to form an upper fastener and a lower fastener.

4. The bezel according to claim 1, wherein said second positioning device further has first and second planer surfaces and third and fourth prop surfaces for positioning and securing said second modular jack, and said third and fourth slots are oblong-shaped.

5. The bezel according to claim 4, wherein said second modular jack has third and fourth protrusions for respectively engaging said third and fourth prop surfaces, and said third and fourth protrusions are respectively located on left and right sides of said second modular jack to form a left fastener and a right fastener.

6. The bezel according to claim 1 further connected to a first plate, wherein said bezel has a protrusion for positioning and securing said first plate to a metal panel, and said first plate and said bezel are integrally formed.

7. The bezel according to claim 1 being a first bezel and connected to a second plate with a second bezel, wherein said first bezel, said second bezel and said second plate are integrally formed.

8. The bezel according to claim 1 being a first bezel and connected to a third plate with a second bezel and a third bezel, wherein said first bezel, said second bezel, said third bezel and said third plate are integrally formed.

9. The bezel according to claim 1 being a first bezel and connected to a fourth plate with a second bezel, a third bezel and a fourth bezel, wherein said first bezel, said second bezel, said third bezel, said fourth bezel and said fourth plate are integrally formed.

10. A bezel for positioning a modular jack, wherein said modular jack is one of first and second types of differently-shaped modular jacks, the bezel comprising:

a body for containing therein one of said modular jacks;

a first positioning device having first and second slots on first opposing sides of said body configured to position only said first type of modular jack; and a second positioning device configured to position only said second type of modular jack.

11. The bezel according to claim 10, wherein said second positioning device comprises third and fourth slots on second opposing sides of said body for positioning said second modular jack.

12. The bezel according to claim 11, wherein said third and fourth slots are oblong-shaped, and said second positioning device further has first and second planar surfaces and first and second prop surfaces for positioning and securing said second modular jack.

13. The bezel according to claim 12, wherein said second modular jack has third and fourth protrusions for respectively engaging said first and second prop surfaces, and said third and fourth protrusions are respectively located on left and right sides of said second modular jack to form a left fastener and a right fastener.

14. The bezel according to claim 10, wherein said first and second slots are oblong-shaped, and said first positioning device further has first and second cambered surfaces and third and fourth prop surfaces for positioning and securing said first modular jack.

15. The bezel according to claim 14, wherein said first modular jack has first and second protrusions for respectively engaging said third and fourth prop surfaces, and said first and second protrusions are respectively located on a top surface of an extended piece of said first modular jack to form an upper fastener and a lower fastener.

16. A bezel for positioning a modular jack, wherein said modular jack is one of first and second types of differently-shaped modular jacks, the bezel comprising:

a body for containing therein one of said modular jacks;

a first positioning device configured to position only said first type of modular jack; and a second positioning device configured to position only said second type of modular jack.

17. The bezel according to claim 16, wherein said first positioning device comprises first and second slots on first opposing sides of said body for positioning and securing said first modular jack and said second positioning device includes third and fourth slots on second opposing sides of said body for positioning and securing said second modular jack.

18. The bezel according to claim 17, wherein said first and second slots are oblong-shaped, and said first positioning device further has first and second cambered surfaces and first and second prop surfaces for positioning and securing said first modular jack.

19. The bezel according to claim 18, wherein said first modular jack has first and second protrusions for respectively engaging said first and second prop surfaces, and said first and second protrusions are respectively located on a top surface of an extended piece of said first modular jack to form an upper fastener and a lower fastener.

20. The bezel according to claim 17, wherein said third and fourth slots are oblong-shaped, and said second positioning device has first and second planar surfaces and third and fourth prop surfaces for positioning and securing said second modular jack.

* * * * *